US011193706B2

(12) United States Patent
Shao et al.

(10) Patent No.: US 11,193,706 B2
(45) Date of Patent: Dec. 7, 2021

(54) ICE DISCHARGER AND REFRIGERATOR COMPRISING THE SAME

(71) Applicants: HEFEI HUALING CO., LTD., Hefei (CN); HEFEI MIDEA REFRIGERATOR CO., LTD., Hefei (CN)

(72) Inventors: Yang Shao, Hefei (CN); Zengqiang Si, Hefei (CN); Guangqing Yang, Hefei (CN); Zhengguang Lv, Hefei (CN); Jincai Wang, Hefei (CN)

(73) Assignees: HEFEI HUALING CO., LTD., Hefei (CN); HEFEI MIDEA REFRIGERATOR CO., LTD., Hefei (CN)

( * ) Notice: Subject to any disclaimer, the term of this patent is extended or adjusted under 35 U.S.C. 154(b) by 185 days.

(21) Appl. No.: 16/485,754

(22) PCT Filed: May 24, 2017

(86) PCT No.: PCT/CN2017/085754
§ 371 (c)(1),
(2) Date: Aug. 13, 2019

(87) PCT Pub. No.: WO2018/145370
PCT Pub. Date: Aug. 16, 2018

(65) Prior Publication Data

US 2020/0049395 A1 Feb. 13, 2020

(30) Foreign Application Priority Data

Feb. 13, 2017 (CN) ..... 201710076968.6

(51) Int. Cl.
*F25C 1/24* (2018.01)
*F25C 5/182* (2018.01)

(52) U.S. Cl.
CPC ..... *F25C 1/24* (2013.01); *F25C 5/182* (2013.01)

(58) Field of Classification Search
CPC .... F25C 5/20; F25C 5/22; F25C 5/182; F25C 2400/04
(Continued)

(56) References Cited

U.S. PATENT DOCUMENTS 1,184,074 A * 5/1916 Clark ..... B65B 3/323 222/168.5
8,746,002 B2 * 6/2014 Lee ..... F25C 5/22 62/320
(Continued)

FOREIGN PATENT DOCUMENTS

CN 102654341 A 9/2012
CN 105402970 A 3/2016
(Continued)

OTHER PUBLICATIONS

International Search Report, dated Nov. 14, 2017, for International Application No. PCT/CN2017/085754, 2 pages.

*Primary Examiner* — Steve S Tanenbaum
(74) *Attorney, Agent, or Firm* — Seed IP Law Group LLP

(57) ABSTRACT

An ice discharger is disclosed comprising an ice storage box provided with an ice outlet and an ice inlet, and an ice stirring unit and an ice pushing unit located within the ice storage box; the ice stirring unit comprises an ice stirring section disposed inside the ice storage box and a stirrer disposed rotatably within the ice stirring section, an ice cube inlet and an ice cube outlet are disposed at the top and on the side wall of the ice stirring section, respectively; and the ice pushing unit comprises a circular ice discharging passage disposed between the ice stirring section and the ice storage box, and an ice pushing assembly disposed rotatably within the circular ice discharging passage and for pushing an ice
(Continued)

cube to the ice outlet of ice storage box thereby improving the uniformity of the amount of discharged ice.

16 Claims, 3 Drawing Sheets

(58) Field of Classification Search
USPC ..... 221/265, 277, 297, 237, 222, 226, 231
See application file for complete search history.

(56) References Cited

U.S. PATENT DOCUMENTS 8,862,266 B2* 10/2014 van Ooyen ..... G07F 11/44 700/240
2008/0295536 A1* 12/2008 Kim ..... F25C 5/22 62/340
2011/0253737 A1* 10/2011 Portney ..... B65D 83/0454 221/277
2013/0305763 A1* 11/2013 Nuss ..... F25C 5/12 62/320
2013/0312448 A1* 11/2013 Schukar ..... B01F 11/0082 62/340
2015/0135738 A1* 5/2015 Choo ..... F25C 5/046 62/66

FOREIGN PATENT DOCUMENTS

| | | | |
|---|---|---|---|
| CN | 105509391 | A | 4/2016 |
| CN | 105546899 | A | 5/2016 |
| JP | 56-140858 | A | 11/1981 |
| JP | 2009-30846 | A | 2/2009 |
| JP | 2016-23841 | A | 2/2016 |
| KR | 10-1303618 | | 9/2013 |

* cited by examiner

ICE DISCHARGER AND REFRIGERATOR COMPRISING THE SAME

CROSS-REFERENCE TO RELATED APPLICATION

This application claims priority to Chinese patent application No. 201710076968.6 filed on Feb. 13, 2017, entitled "Ice Discharging Device and Refrigerator Containing Said Ice Discharging Device," which is incorporated herein by reference in its entirety.

BACKGROUND

Technical Field

The present disclosure relates to the field of refrigerator technologies, and in particular, to an ice discharger used for an ice discharging system and a refrigerator comprising the ice discharger.

Description of the Related Art

With the continuous improvement of people's living standards, a refrigerator with automatic ice making function is gaining in popularity among more and more consumers. Generally, such refrigerator comprises an automatic ice cube maker including ice making system, ice storage system, ice discharging system and the like, wherein the ice making system stores the made ice cube in the ice storage system, and when the ice cube is used by the consumers, it is discharged from the ice storage system by the ice discharging system.

The existing ice discharging system usually consists of an ice crushing device disposed in an ice storage box. Although the ice cube is pushed by a stirring knife and discharged from the ice outlet under the action of gravity, the amount of discharged ice cubes is uneven, that is, more ice cubes are discharged sometimes and less ice cubes are discharged sometimes so that the user has poor ice cube-taking experience.

BRIEF SUMMARY

Technical Problems to be Solved

The present disclosure describes an ice discharger capable of improving the uniformity of the ice discharge amount.

The present disclosure describes a refrigerator comprising the ice discharger.

Technical Solutions

In order to solve the technical problem above, the present disclosure provides an ice discharger used for an ice discharging system, comprising an ice storage box as well as an ice stirring unit and an ice pushing unit located within the ice storage box. An ice outlet is disposed at a position of the bottom wall of the ice storage box near the side wall thereof, and an ice inlet is disposed at the top of the ice storage box. The ice stirring unit comprises an ice stirring section disposed in a central area at the lower portion of the ice storage box and a stirrer disposed rotatably within the ice stirring section. An ice cube inlet allowing the ice cube to be stirred to fall is disposed at the top of the ice stirring section and an ice cube outlet is disposed on the side wall of the ice stirring section. The ice pushing unit comprises a circular ice discharging passage and an ice pushing assembly. The circular ice discharging passage is a space between the ice stirring section and the inner wall of the ice storage box. The circular ice discharging passage communicates with the ice outlet and the ice cube outlet of the ice stirring section, respectively. The ice pushing assembly is disposed rotatably within the circular ice discharging passage and is configured to push an ice cube coming out of the ice cube outlet of the ice stirring section to the ice outlet of the ice storage box.

In an embodiment of the present disclosure, the ice stirring section is enclosed by an ice cube guiding wall located on the bottom wall of the ice storage box, the ice cube guiding wall comprises a circular arc segment located at the center of the ice storage box and a connecting segment having two ends connecting the circular arc segment and the side wall of the ice storage box, respectively.

In an embodiment of the present disclosure, the connecting segment is an arc-shaped structure, and the circular arc segment is in smooth transition connection with the connecting segment.

In an embodiment of the present disclosure, the ice pushing assembly comprises a circular-ring ice cube pushing plate disposed above the circular ice discharging passage, which is enclosed by the circular-ring ice cube pushing plate, the side wall and the bottom wall of the ice storage box, and the circular arc segment of the ice cube guiding wall, a plurality of ice cube pushing blades radially arranged are disposed on the lower surface of the circular-ring ice cube pushing plate, and bottoms of the ice cube pushing blades are higher than the top of the straight-line segment of the ice cube guiding wall.

In an embodiment of the present disclosure, the ice pushing assembly comprises a circular-ring ice cube pushing plate and a cylindrical ice cube pushing plate. The circular-ring ice cube pushing plate is disposed above the circular ice discharging passage, the cylindrical ice cube pushing plate is connected with the outer circumference of the circular-ring ice cube pushing plate. The circular ice discharging passage is enclosed by the circular-ring ice cube pushing plate, the side wall and the bottom wall of the ice storage box. The circular arc segment of the ice cube guiding wall and a plurality of ice cube pushing blades radially arranged are disposed on the inner side wall of the cylindrical ice cube pushing plate. Bottoms of the ice cube pushing blades are higher than the top of the straight-line segment of the ice cube guiding wall.

In an embodiment of the present disclosure, the ice stirring section comprises a circular top plate and an ice cube guiding wall disposed on a lower surface of the circular top plate. The ice cube guiding wall comprises a circular arc segment located at the center of the ice storage box and a connecting segment having two ends connecting the circular arc segment and the side wall of the ice storage box, respectively. The circular ice discharging passage is enclosed by the circular top plate, the side wall and the bottom wall of the ice storage box, and the circular arc segment of the ice cube guiding wall.

In an embodiment of the present disclosure, the connecting segment is an arc-shaped structure, and the circular arc segment is in smooth transition connection with the connecting segment.

In an embodiment of the present disclosure, the ice pushing assembly comprises a circular-ring ice cube pushing plate disposed below the circular ice discharging passage. A plurality of ice cube pushing blades radially arranged are disposed on the upper surface of the circular-ring ice cube pushing plate. An ice falling port is disposed between adjacent ice cube pushing blades on the circular-ring ice cube pushing plate. The lower surface of the circular-ring ice cube pushing plate is in fit with the bottom of the ice storage box. The bottom of the straight-line segment of the ice cube guiding wall should be higher than the tops of the ice cube pushing blades.

In an embodiment of the present disclosure, the plurality of ice cube pushing blades are uniformly disposed along the circumferential direction of the ice cube pushing plate.

The present disclosure also discloses a refrigerator comprising an ice cube maker, further comprising an ice discharger as described above, wherein the ice inlet of the ice discharger communicates with an outlet of the ice cube maker.

Beneficial Effects

According to the ice discharger provided by the present disclosure, by disposing, in the ice storage box, the ice pushing unit comprising the ice pushing assembly which can be rotatably disposed in the circular ice discharging passage between the ice storage box and the ice stirring unit, so as to push ice cubes coming out of the ice stirring unit to the ice outlet, it is more convenient for the ice cubes to move inside the circular ice discharging passage due to the ice pushing unit and not get stuck, thereby improving the uniformity of the ice discharge amount.

Description of the reference numbers

Figure 1:
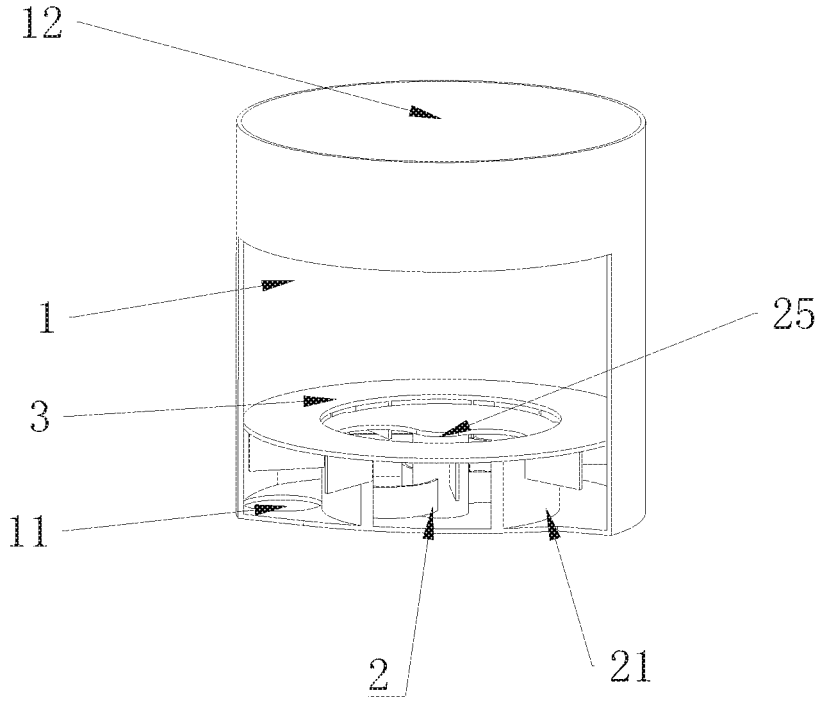
FIG. 1 is a perspective view of a preferred embodiment of an ice discharger used for an ice discharging system in accordance with the present disclosure.

| | | | |
|---|---|---|---|
| 1 | ice storage box; | 11 | ice outlet; |
| 12 | ice inlet; | 2 | ice stirring unit; |
| 21 | ice cube guiding wall; | 22 | ice stirring section; |
| 23 | stirring shaft; | 24 | ice stirring blade; |
| 25 | ice cube inlet; | 3 | ice pushing unit; |
| 31 | circular ice discharging passage; | | |
| 32 | circular-ring ice cube pushing plate; | | |
| 33 | ice cube pushing blades; | 35 | ice falling port; |
| 4 | ice cube | | |

DETAILED DESCRIPTION

The specific implementations of the present disclosure are further described in detail below with reference to the drawings and embodiments. The following embodiments are intended to illustrate the disclosure, but are not intended to limit the scope of the disclosure.

In the description of the present disclosure, it is to be understood that the orientation or positional relations specified by terms such as "center," "longitudinal," "transverse," "length," "width," "thickness," "upper," "lower," "front," "rear," "left," "right," "vertical," "horizontal," "top," "bottom," "inside," "outside," "clockwise," "counterclockwise," "axial," "radial," "circumferential" and the like are based on the orientation or positional relations shown in the drawings, which is merely for convenience of description of the present disclosure and simplified description, and does not indicate or imply that the stated device or element must have the particular orientation and constructs and operates in a particular orientation, and thus it is not to be construed as limiting the disclosure.

Furthermore, the terms "first" and "second" are used for descriptive purposes only and are not to be construed as indicating or implying a relative importance or implicitly indicating the number of technical features indicated. Thus, features defining "first" or "second" may include at least one of the features, either explicitly or implicitly. In the description of the present disclosure, the meaning of "a plurality" is at least two, such as two, three, etc., unless specifically defined otherwise.

In the present disclosure, unless explicitly stated and defined otherwise, the terms "installed," "connected with," "connected," "fixed" and the like shall be understood broadly, for example, it may be either fixedly connected or detachably connected, or can be integrated; it may be mechanically connected, or electrically connected or communicated with each other; it may be directly connected or indirectly connected through an intermediate medium, or may be an internal connection of two elements or an interaction relation between two elements, unless specifically defined otherwise. The specific meanings of the terms above in the present disclosure can be understood by a person skilled in the art in accordance with specific conditions.

Embodiment 1

Figure 2:
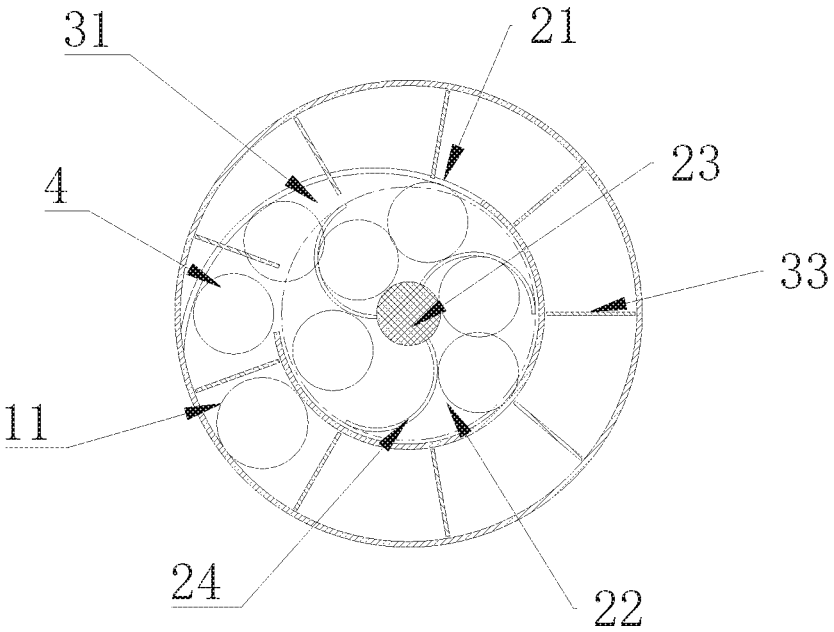
FIG. 2 is a top plan view of the ice discharger of FIG. 1.

FIGS. 1 and 2 illustrate a preferred embodiment of an ice discharger in accordance with the present disclosure. As shown in FIG. 1, the ice discharger comprises an ice storage box 1 as well as an ice stirring unit 2 and an ice pushing unit 3 located within the ice storage box 1. The bottom wall of the ice storage box 1 is provided with an ice outlet 11 through which ice cubes pass. The ice outlet 11 is located at a position of the bottom wall of the ice storage box 1 near the side wall thereof. An ice inlet 12 is disposed at the top of the ice storage box 1. The ice stirring unit 2 comprises an ice stirring section 22 disposed in central area at the lower portion of the ice storage box 1 and a stirrer disposed rotatably within the ice stirring section 22, an ice cube inlet allowing the ice cube to be stirred to fall from the upper portion of the ice storage box 1 is disposed at the top of the ice stirring section 22, and an ice cube outlet is disposed on the side wall of the ice stirring section 22. The ice pushing unit 3 comprises a circular ice discharging passage 31 and an ice pushing assembly; wherein the circular ice discharging passage 31 is a space between the ice stirring section 22 and the inner wall of the ice storage box 1, and communicates with the ice outlet 11 and the ice cube outlet of the ice stirring section 22, respectively. The ice pushing assembly is disposed rotatably within the circular ice discharging passage 31 and is configured to push an ice cube 4 coming out of the ice cube outlet of the ice stirring section 22 to the ice outlet 11 of the ice storage box 1.

The ice cube 4 enters the ice storage box 1 from the ice inlet 12 at the top of the ice storage box 1. When it is required to be discharged, the ice cube 4 enters the ice stirring section 22 from the ice cube inlet 25 above the ice stirring section 22 due to gravity, the stirrer stirs and pushes a part of the ice cubes 4 to move toward the ice cube outlet, and the ice cube 4 is pushed from the ice cube outlet of the ice stirring section 22 to the circular ice discharging passage 31 and then to the ice outlet 11 under the pushing effect of the ice pushing assembly to be discharged from the ice outlet 11 uniformly. Due to the presence of the ice pushing unit, it is more convenient for the ice cube to move inside the circular ice discharging passage 31 and not get stuck, thereby improving the uniformity of the ice discharge amount.

In the embodiment of the present disclosure, the ice stirring section 22 is enclosed by an ice cube guiding wall 21 located on the bottom wall of the ice storage box 1. The ice cube guiding wall 21 comprises a circular arc segment located at the center of the ice storage box 1 and a connecting segment having two ends respectively connecting the circular arc segment and the side wall of the ice storage box 1, so as to ensure the ice cube 4 to smoothly enter the circular ice discharging passage 31. Further, the connecting segment is an arc-shaped structure and the circular arc segment is in smooth transition connection with the connecting segment such that it is more convenient for the ice cube to move and not get stuck. In some other embodiments of the present disclosure, the connecting segment may also adopt a linear structure.

The stirrer comprises a stirring shaft 23 and three ice stirring blades 24 distributed uniformly along the circumference of the stirring shaft 23, wherein the lower end of the stirring shaft 23 is connected with a driving device (not shown), for example, a motor, after passing through the bottom wall of the ice storage box 1. The stirring shaft 23 is driven to rotate by the driving device, so as to further drive the ice stirring blades 24 to rotate together. During the rotation, the separation of the ice cubes 4 is achieved, and the ice cube 4 can be pushed to move to the ice cube outlet of the ice stirring section 22 and enter the ice discharging passage 31 through the ice cube outlet. In some other embodiments of the present disclosure, the number of the ice stirring blades 24 can also be 4, 5, 6 and the like. However, in order to ensure the stirring capability of the stirrer, the number of the ice stirring blades 24 is at least two.

Figure 3:
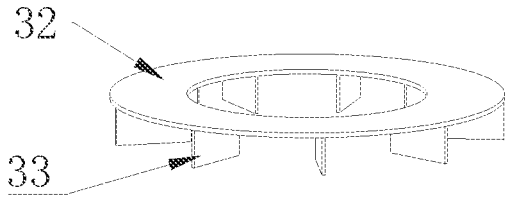
FIG. 3 is a schematic structural view in which the ice cube pushing blades of the ice discharger of FIG. 1 is located on the lower surface of the ice cube pushing plate.

As shown in FIG. 3, the ice pushing assembly comprises a circular-ring ice cube pushing plate 32 disposed above the circular ice discharging passage 31. The circular ice discharging passage 31 is enclosed by the circular-ring ice cube pushing plate 32, the side wall and the bottom wall of the ice storage box 1, and the circular arc segment of the ice cube guiding wall 21. A plurality of ice cube pushing blades 33 radially arranged are disposed on the lower surface of the circular-ring ice cube pushing plate 32 and located inside the circular ice discharging passage 31. Bottoms of the ice cube pushing blades 33 are higher than the top of the straight-line segment of the ice cube guiding wall 21 so as to ensure that the rotation of the ice cube pushing blades 33 is not affected by the straight-line segment of the ice cube guiding wall 21. Since the ice cube pushing blades 33 are used for pushing the ice cube 4 coming out of the ice cube outlet of the ice stirring section 22 to the ice outlet 11 of the ice storage box 1, the distance between the bottom portion of the ice cube pushing blades 33 and the bottom wall of the ice storage box 1 may be less than the height of the ice cube 4. In addition, it is preferred that the plurality of ice cube pushing blades 33 are disposed uniformly along the circumferential direction of the circular-ring ice cube pushing plate 32. In order to further ensure the ice cubes 4 are evenly and orderly discharged from the ice outlet 11, it is preferable that the gap between two adjacent ice cube pushing blades 33 can accommodate only one ice cube 4.

In order to realize the rotation of the circular-ring ice cube pushing plate 32, teeth (not shown) are disposed on the periphery of the circular-ring ice cube pushing plate 32. A window is disposed at the position of the ice storage box 1 corresponding to the teeth of the circular-ring ice cube pushing plate 32 which is engaged with an external gear (not shown) at the window to be driven to rotate through the external gear.

Embodiment 2

The present embodiment is substantially the same as the embodiment 1. For the sake of brevity of description, the same technical features as those of the embodiment 1 will not be described in the description of the present embodiment, and only the difference between this embodiment and embodiment 1 will be described.

Figure 4:
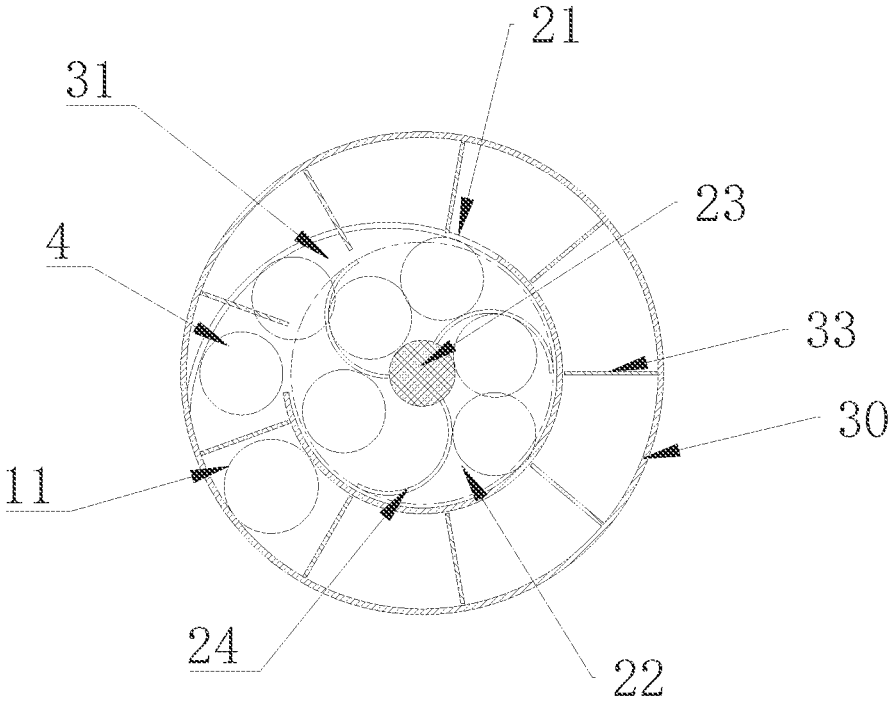
FIG. 4 is a cross-sectional view showing another embodiment of an ice discharger in which the ice cube pushing blades are located on the side wall of the ice cube pushing plate, according to the present disclosure.

As shown in FIG. 4, the ice pushing assembly comprises a circular-ring ice cube pushing plate 32 and a cylindrical ice cube pushing plate 30, wherein the circular-ring ice cube pushing plate 32 is disposed above the circular ice discharging passage 31 and the cylindrical ice cube pushing plate 30 is connected with the outer circumference of the circular-ring ice cube pushing plate 32. In this case, the circular ice discharging passage 31 is enclosed by the circular-ring ice cube pushing plate 32, the side wall and the bottom wall of the ice storage box 1, and the circular arc segment of the ice cube guiding wall 21. A plurality of ice cube pushing blades 33 radially arranged are disposed on the inner side wall of the cylindrical ice cube pushing plate 30 and bottoms of the ice cube pushing blades 33 are higher than the top of the straight-line segment of the ice cube guiding wall 21.

Embodiment 3

The present embodiment is substantially the same as the embodiment 1. For the sake of brevity of description, the same technical features as those of the embodiment 1 will not be described in the description of the present embodiment, and only the difference between this embodiment and embodiment 1 will be described.

Figure 5:
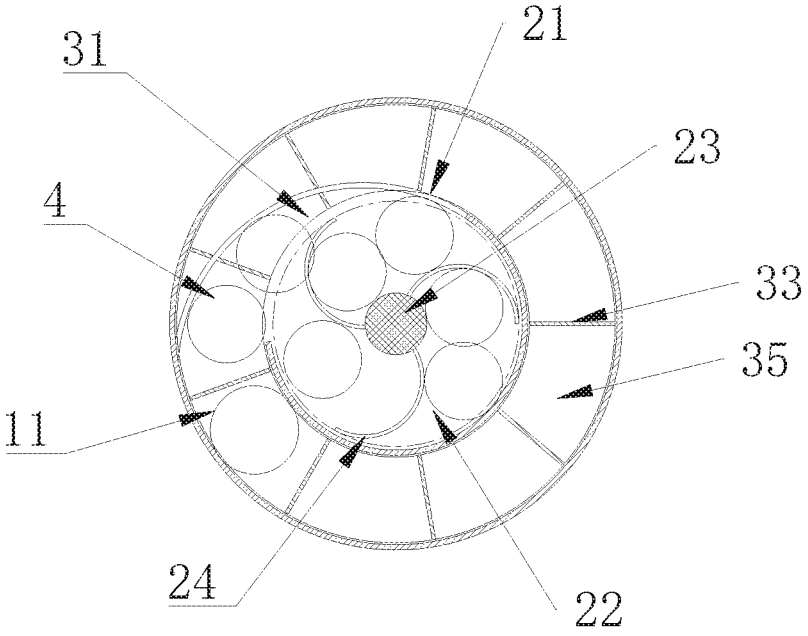
FIG. 5 is a cross-sectional view showing another embodiment of an ice discharger in which the ice cube pushing blades are located on the upper surface of the ice cube pushing plate, according to the present disclosure.

As shown in FIG. 5, the ice stirring section comprises a circular top plate and an ice cube guiding wall 21 disposed on a lower surface of the circular top plate. The ice cube guiding wall 21 comprises a circular arc segment located at the center of the ice storage box 1 and a connecting segment having two ends respectively connecting the circular arc segment and the side wall of the ice storage box 1, so as to ensure that the ice cube 4 smoothly enters the circular ice discharging passage 31. In this case, the circular ice discharging passage 31 is enclosed by the circular top plate, the side wall and the bottom wall of the ice storage box 1, and the circular arc segment of the ice cube guiding wall 21. The ice pushing assembly comprises a circular-ring ice cube pushing plate 32 disposed below the circular ice discharging passage 31, a plurality of ice cube pushing blades 33 radially arranged are disposed on the upper surface of the circular-ring ice cube pushing plate 32, an ice falling port 35 is disposed between adjacent ice cube pushing blades 33 on the circular-ring ice cube pushing plate 32, the lower surface of the circular-ring ice cube pushing plate 32 is in fit with the bottom of the ice storage box 1, and the bottom of the straight-line segment of the ice cube guiding wall 21 should be higher than the tops of the ice cube pushing blades 33.

The ice cubes 4 enter the ice storage box 1 from the ice inlet above the ice storage box 1. When it is required to be discharged, the ice cubes 4 enter the ice stirring section 22 from the ice cube inlet of the ice storage box 1 due to gravity, the stirring shaft 23 rotates under the driving of an external force and drives the ice stirring blades 24 to rotate, and the ice cubes 4 are pushed to the circular ice discharging passage 31 after being stirred by the ice stirring blades 24 and guided by the ice cube guiding wall 21 and then pushed to move to the ice outlet 11 under the rotation of the ice cube pushing blades 33 driven by the circular-ring ice cube pushing plate 32 and finally discharged from the ice outlet 11 uniformly. Due to the presence of the circular-ring ice cube pushing plate 32, it is more convenient for the ice cubes 4 to move and not get stuck, thereby improving the uniformity of the ice discharge amount.

The present disclosure also discloses a refrigerator comprising an ice cube maker and an ice discharger as described above, wherein the ice inlet of the ice discharger communicates with an outlet of the ice cube maker.

Since the refrigerator provided by the embodiment of the present disclosure is provided with the above-mentioned ice discharger, it also has all the advantages of the above-mentioned ice discharge, which thus will not be described herein.

The embodiments above are only the example embodiments of the present disclosure, and are not intended to limit the present disclosure. Any modifications, equivalent substitutions, improvements, etc., which are included in the spirit and scope of the present disclosure, should fall within the protection scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An ice discharging system, comprising:

an ice storage box;

an ice stirring unit located within the ice storage box; and an ice pushing unit located within the ice storage box, the ice pushing unit disposed radially outward from the ice stirring unit, the ice pushing unit being around the ice stirring unit;

wherein the ice storage box includes an ice outlet disposed at a position on a bottom wall of the ice storage box near a side wall of the ice storage box, and an ice inlet disposed at a top of the ice storage box;

wherein the ice stirring unit includes an ice stirring section disposed in a central area at a lower portion of the ice storage box, a stirrer disposed rotatably within the ice stirring section and including a stirring shaft and a plurality of ice stirring blades coupled to the ice stirring shaft, an ice cube inlet disposed at the top of the ice stirring section and configured to allow ice cubes to be stirred to fall through, and an ice cube outlet disposed on a side wall of the ice stirring section; and wherein the ice pushing unit includes a circular ice discharging passage and an ice pushing assembly, the circular ice discharging passage being a space between the ice stirring section and an inner surface of the sidewall of the ice storage box, the circular ice discharging passage communicates with the ice outlet and the ice cube outlet of the ice stirring section, respectively, the ice pushing assembly being disposed rotatably within the circular ice discharging passage and configured to push an ice cube coming out of the ice cube outlet of the ice stirring section to the ice outlet of the ice storage box, the ice pushing assembly including a circular-ring ice cube pushing plate and a plurality of ice cube pushing blades being radially arranged on the circular-ring ice cube pushing plate, the plurality of ice cube pushing blades being radially disposed outward from the plurality of ice stirring blades, the plurality of ice cube pushing blades being separate and distinct from the plurality of ice cube stirring blades, the plurality of ice cube pushing blades configured to push the ice cube coming out of the ice cube outlet of the ice stirring section to the ice outlet of the ice storage box.

2. The ice discharging system of claim 1, wherein the ice stirring section is enclosed by an ice cube guiding wall located on the bottom wall of the ice storage box, the ice cube guiding wall including a circular arc segment located at a center of the ice storage box and a connecting segment having two ends connecting the circular arc segment and the side wall of the ice storage box, respectively.

3. The ice discharging system of claim 2, wherein the connecting segment is an arc-shaped structure, and the circular arc segment is in smooth transition connection with the connecting segment.

4. The ice discharging system of claim 2, wherein the ice pushing assembly includes a circular-ring ice cube pushing plate disposed above the circular ice discharging passage, the circular ice discharging passage being enclosed by the circular-ring ice cube pushing plate, the side wall and the bottom wall of the ice storage box, and the circular arc segment of the ice cube guiding wall, the plurality of ice cube pushing blades being radially arranged and disposed on a lower surface of the circular-ring ice cube pushing plate, and bottom surfaces of the ice cube pushing blades being higher than a top surface of the ice cube guiding wall.

5. The ice discharging system of claim 2, wherein the ice pushing assembly includes a circular-ring ice cube pushing plate and a cylindrical ice cube pushing plate, the circular-ring ice cube pushing plate being disposed above the circular ice discharging passage, the cylindrical ice cube pushing plate being connected with an outer circumference of the circular-ring ice cube pushing plate, the circular ice discharging passage being enclosed by the circular-ring ice cube pushing plate, the side wall and the bottom wall of the ice storage box, and the circular arc segment of the ice cube guiding wall, the plurality of ice cube pushing blades being radially arranged and disposed on an inner side wall of the cylindrical ice cube pushing plate, and bottom surfaces of the ice cube pushing blades being higher than a top surface of the ice cube guiding wall.

6. The ice discharging system of claim 5, wherein the plurality of ice cube pushing blades are substantially uniformly disposed along a circumferential direction of the ice cube pushing plate.

7. The ice discharging system of claim 1, wherein the ice stirring section comprises a circular top plate and an ice cube guiding wall disposed on a lower surface of the circular top plate, the ice cube guiding wall including a circular arc segment located at a center of the ice storage box and a connecting segment having two ends connecting the circular arc segment and the side wall of the ice storage box, respectively, and the circular ice discharging passage being enclosed by the circular top plate, the side wall and the bottom wall of the ice storage box, and the circular arc segment of the ice cube guiding wall.

8. The ice discharging system of claim 7, wherein the connecting segment is an arc-shaped structure, and the circular arc segment is in smooth transition connection with the connecting segment.

9. The ice discharging system of claim 7, wherein the ice pushing assembly includes a circular-ring ice cube pushing plate disposed below the circular ice discharging passage, the plurality of ice cube pushing blades radially arranged and disposed on an upper surface of the circular-ring ice cube pushing plate, and an ice falling port disposed between adjacent ice cube pushing blades on the circular-ring ice cube pushing plate, the lower surface of the circular-ring ice cube pushing plate being in fit with the bottom of the ice storage box, a bottom surface of the ice cube guiding wall being higher than top surfaces of the ice cube pushing blades.

10. The ice discharging system of claim 9, wherein the plurality of ice cube pushing blades are substantially uniformly disposed along a circumferential direction of the ice cube pushing plate.

11. A refrigerator, comprising:

an ice cube maker having an ice cube outlet; and an ice discharger having an ice inlet communicatively coupled to the ice cube outlet of the ice cube maker, the ice discharger including:

an ice storage box;

an ice stirring unit located within the ice storage box; and an ice pushing unit located within the ice storage box and around the ice stirring unit, the ice pushing unit extending radially outward from the ice stirring unit;

wherein the ice storage box includes an ice inlet and an ice outlet;

wherein the ice stirring unit includes a stirrer and an ice cube guiding wall, the stirrer configured to rotatably stir ice cubes to move within the ice cube guiding wall and to exit the stirring unit into an ice discharging passage space between the ice stirring section and an inner wall of the ice storage box;

wherein the ice cube guiding wall includes a circular arc segment located at a center of the ice storage box and a connecting segment having two ends connecting the circular arc segment and a side wall of the ice storage box, respectively;

wherein the ice pushing unit includes an ice pushing assembly disposed rotatably within the ice discharging passage space;

wherein the ice pushing assembly includes a circular-ring ice cube pushing plate disposed below the ice discharging passage space, a plurality of ice cube pushing blades radially arranged and disposed on an upper surface of the circular-ring ice cube pushing plate, and an ice falling port disposed between adjacent ice cube pushing blades on the circular-ring ice cube pushing plate, the lower surface of the circular-ring ice cube pushing plate matching with a bottom of the ice storage box.

12. The refrigerator of claim 11, wherein the connecting segment is an arc-shaped structure, and the circular arc segment is in smooth transition connection with the connecting segment.

13. The refrigerator of claim 11, wherein the ice cube guiding wall includes a bottom surface being higher than top surfaces of the ice cube pushing blades on the upper surface of the circular-ring ice cube pushing plate.

14. The refrigerator of claim 11, wherein the plurality of ice cube pushing blades are substantially uniformly disposed along a circumferential direction of the ice cube pushing plate.

15. A refrigerator, comprising:

an ice cube maker having an ice cube outlet; and an ice discharger having an ice inlet communicatively coupled to the ice cube outlet of the ice cube maker, the ice discharger including:

an ice storage box;

an ice stirring unit located within the ice storage box; and an ice pushing unit located within the ice storage box;

wherein the ice storage box includes an ice inlet and an ice outlet;

wherein the ice stirring unit includes a stirrer and an ice cube guiding wall, the stirrer configured to rotatably stir ice cubes to move within the ice cube guiding wall and to exit the stirring unit into an ice discharging passage space between the ice stirring section and an inner wall of the ice storage box;

wherein the ice cube guiding wall includes a circular arc segment located at a center of the ice storage box and a connecting segment having two ends connecting the circular arc segment and a side wall of the ice storage box, respectively;

wherein the ice pushing unit includes an ice pushing assembly disposed rotatably within the ice discharging passage space;

wherein the ice pushing assembly includes a circular-ring ice cube pushing plate disposed above the ice discharging passage space, the ice discharging passage space being enclosed by the circular-ring ice cube pushing plate, the side wall and a bottom wall of the ice storage box, and the circular arc segment of the ice cube guiding wall, the ice discharger further including a plurality of ice cube pushing blades radially arranged and disposed on a lower surface of the circular-ring ice cube pushing plate, bottom surfaces of the ice cube pushing blades being higher than a top surface of the ice cube guiding wall.

16. The refrigerator of claim 15, wherein the connecting segment is an arc-shaped structure, and the circular arc segment is in smooth transition connection with the connecting segment.

* * * * *